US005979210A

United States Patent [19]

Baur et al.

[11] Patent Number: 5,979,210

[45] Date of Patent: Nov. 9, 1999

[54] DRAWING DEVICE FOR A PRESS WITH CONTROL DEVICE FOR MAINTAINING PRESSURE DURING PRESS STOPPAGE

[75] Inventors: Siegfried Baur, Goeppingen; Michael Jung, Bruehl, both of Germany

[73] Assignee: Schuler Pressen GmbH & Co., Germany

[21] Appl. No.: 09/040,414

[22] Filed: Mar. 18, 1998

[30] Foreign Application Priority Data

Mar. 18, 1997 [DE] Germany ..... 197 11 207

[51] Int. Cl.[6] ..... B21D 22/00

[52] U.S. Cl. ..... 72/350; 72/19.9; 72/453.01

[58] Field of Search ..... 72/19.8, 19.9, 72/20.1, 20.2, 21.4, 21.5, 31.1, 31.11, 31.12, 350, 432, 441, 444, 453.01–453.09; 100/50, 269.14, 269.16

[56] References Cited

U.S. PATENT DOCUMENTS

| | | | |
|---|---|---|---|
| 4,229,965 | 10/1980 | Spacek et al. | 72/19.9 |
| 4,896,594 | 1/1990 | Baur et al. . | |
| 5,140,895 | 8/1992 | Imanishi | 100/269.14 |
| 5,188,068 | 2/1993 | Gaterman, III et al. | 123/90.35 |
| 5,638,748 | 6/1997 | Daniel | 72/21.5 |
| 5,735,201 | 4/1998 | Hirao et al. | 100/269.14 |

*Primary Examiner*—Joseph J. Hail, III
*Assistant Examiner*—Ed Tolan
*Attorney, Agent, or Firm*—Evenson, McKeown, Edwards & Lenahan, P.L.L.C.

[57] ABSTRACT

A drawing device for a press is provided with a drawing slide, with a sheet holder having a sheet held therein, and with a pressure cheek which is arranged under the sheet holder and is connected with a piston rod which can be displaced in parallel to the drawing direction. The piston rod is operatively connected with a preacceleration piston of a preacceleration cylinder. The drawing cylinders are applied to the pressure cheek by way of drawing rods, in which case the drawing cylinders have drawing pistons with first and second piston spaces. The first piston space directed to the drawing rod is pressure controlled during the drawing operation for the sheet forming. In the event of a press stoppage during a sheet forming, a control valve device can be activated so that, for maintaining the pressure existing in the first piston space at the start of the press stoppage during the time of the press stoppage, pressure medium can be charged into the first piston space by way of a pressure medium generator.

19 Claims, 1 Drawing Sheet

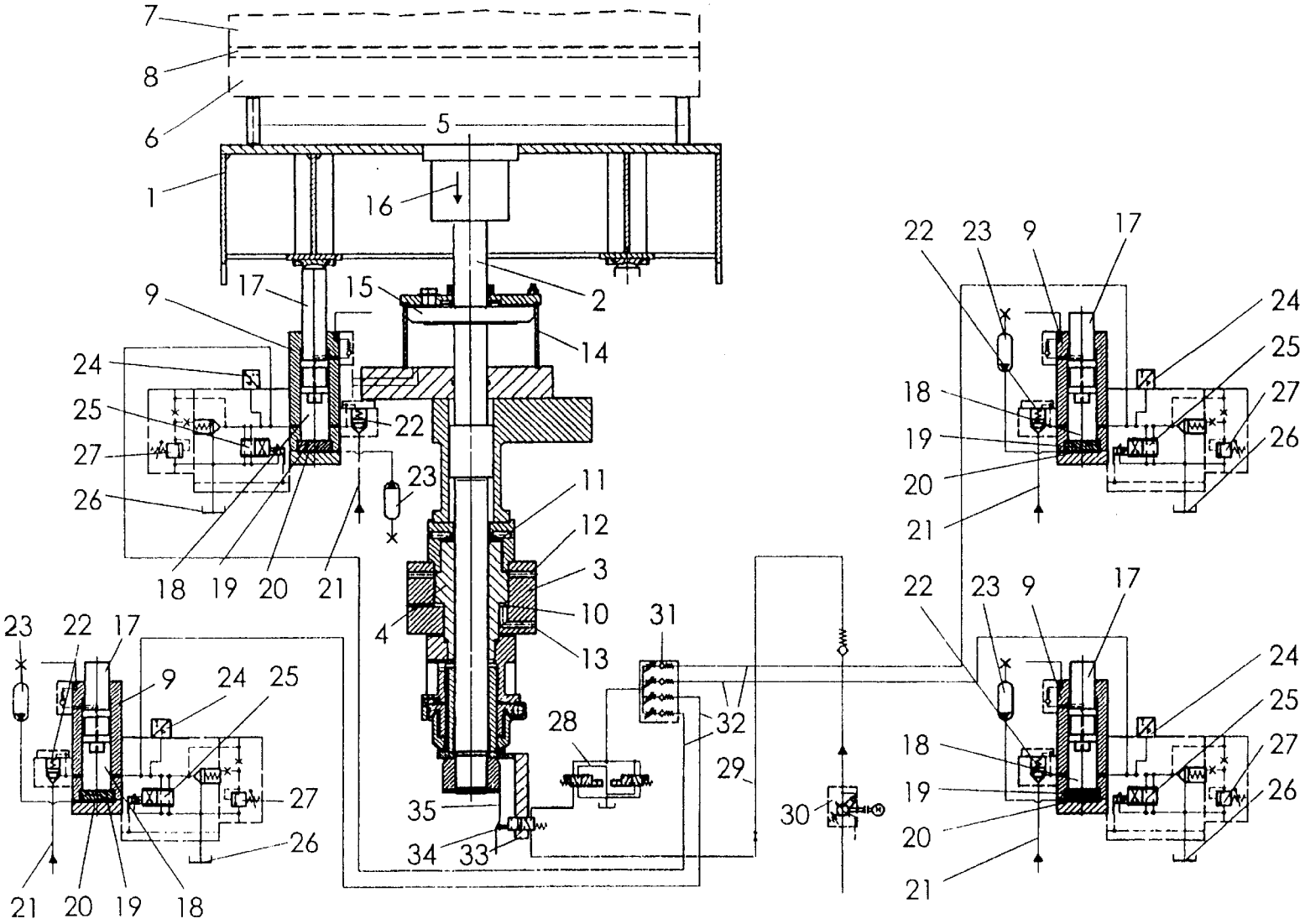
1
2
3
4
5
6
7
8
9
10
11
12
13
14
15
16
17
18
19
20
21
22
23
24
25
26
27
28
29
30
31
32
33
34
35

DRAWING DEVICE FOR A PRESS WITH CONTROL DEVICE FOR MAINTAINING PRESSURE DURING PRESS STOPPAGE

BACKGROUND AND SUMMARY OF THE INVENTION

This application claims the priority of German application 97 11 207.2, filed Mar. 18, 1997, the disclosure of which is expressly incorporated by reference herein.

The present invention relates to a drawing device for a press, and more particularly, to a drawing device having a drawing slide, having a sheet holder with a sheet held in it, having a pressure cheek which is arranged under the sheet holder and which is connected with a piston rod which can be displaced in parallel to the drawing direction and which is operatively connected with a preacceleration piston of a preacceleration cylinder, and drawing cylinders which are applied to the pressure cheek by way of drawing rods, the drawing cylinders having drawing pistons with first and second piston spaces, the first piston space directed to the drawing rod being pressure controlled during the drawing operation for the sheet forming.

DE-OS 36 40 788 describes a drawing device with a preacceleration cylinder and preacceleration piston for preaccelerating, the pressure cheek before the start of the drawing operation in the drawing direction to the speed of the drawing slide. The subsequent sheet forming takes place by a targeted pressure control in the drawing cylinders. For this purpose, in a first piston space of a drawing cylinder directed to the pressure cheek of the drawing device, a correspondingly controlled counterpressure is in each case applied which acts oppositely to the drawing direction.

The known drawing device has a disadvantage in that, when the press is switched off during a drawing operation, the drawing pistons of the drawing cylinders will also stop. Although pressure medium is still situated in the piston spaces of the drawing cylinders, because no more displacement takes place during the machine stoppage, no pressure control also can take place. Simultaneously, however, a slow pressure reduction necessarily takes place in the piston spaces, for example, because of leakages. The resulting pressure change in the system becomes larger, the longer the machine stoppage lasts. This means that the sheet metal parts situated in the press, when the press is restarted, have to be removed from the press as scrap because of the uncontrolled forming as the results of changed pressures.

It is, therefore, an object of the present invention to improve a drawing device such that, also during a stoppage of the press, particularly in the case of an emergency stop, after the restart, the same conditions will exist as at the beginning of the press stoppage so that no scrap has to be removed but, on the contrary, the interrupted sheet forming can immediately take place under the same conditions.

According to the present invention, this object has been achieved by providing that in the case of a press stoppage during a sheet forming, a control valve device can be activated by means of which, for maintaining the pressure existing in the first piston space at the start of the press stoppage, during the time of the press stoppage, pressure medium can be charged into the first piston space by means of a pressure medium generator.

The control according to the present invention by way of the control valve device, which as a type of emergency control, provides during a press stoppage that pressure losses in the respectively first piston space of the drawing cylinders are compensated by a correspondingly controlled addition of pressure medium, ensures that, at the restart of the press, the same pressure exists as at the time of the press stoppage. This means that the interrupted sheet forming can be continued under the same conditions and at the same point so that no scrap parts are created.

The control according to the invention is achieved by relatively simple supplementary parts. This applies particularly if a pressure medium generator, such as the pump, which exists anyhow in the operation of the drawing device, is used as the pressure medium generating device and activates the preacceleration piston of the preacceleration cylinder.

In a simple manner, the control valve device can be constructed as an electrovalve device which is activated in an arbitrary manner by a control command when a press stoppage occurs.

It may advantageously be provided in this case that a path-dependent valve device is arranged between the pressure generator and the control valve device. As the result of this measure, the activation of the control valve device can be carried out in a targeted manner only in the case of a press stoppage when its activation is required and therefore also causes no damage. Thereby, the activation will be carried out only when drawing rods of the drawing pistons are situated in the position in which a sheet forming takes place because of a pressure caused by the drawing slide. If no counterpressure exists as the result of the drawing slide, which is the case, for example, in the upper position of the drawing device, the control valve device is not activated.

In a constructionally simple manner, the path-dependent valve device can be applied to the piston rod of the preacceleration piston by a sensing element, because of the piston rod taking up its respective position; in particular, the piston rod takes over the restoring position of the pressure cheek upwards after a sheet forming has taken place. In other words, the position of the piston rod can be used in a simple manner for controlling the control valve device.

As the sensing element, a roller tappet can, for example, be provided which rolls along a correspondingly shaped curved path on the circumference of the piston rod. For detecting the pressure in the respectively first piston space of the drawing cylinders and its control, a pressure sensor and a proportional valve can be used.

BRIEF DESCRIPTION OF THE DRAWING

Other objects, advantages and novel features of the present invention will become apparent from the following detailed description of the invention when considered in conjunction with the soles figure which shows a cross-sectional view of a drawing device basically of a known construction and also operated in a generally known manner, but using a path-dependent control device in accordance with the present invention which is important to an understanding of the invention.

DETAILED DESCRIPTION OF THE DRAWING

The drawing device has a pressure cheek 1 to which a piston rod 2 of a preacceleration cylinder 3 is applied by a preacceleration piston 4. The piston rod 2 is in an operative connection with the preacceleration piston 4. The pressure cheek 1 is provided with ejector pins 5 above which a sheet holder 6 (shown by broken lines) is arranged. A drawing slide 7, which during the forming operation acts upon a sheet 8 placed on the sheet holder 6, in conjunction with the drawing cylinder 9, generates the forming operation for the sheet 8. In the illustrated embodiment, four drawing cylinders 9 are provided in which, for reasons of clarity, only one drawing cylinder 9 is drawn in the correct position while the three other drawing cylinders 9 are shown separately solely for demonstrating the method of operation of the present invention.

For operating the piston rod 2, the preacceleration cylinder 3 is provided with a first pressure space 10 and with a second pressure space 11 which each have pressure connections 12 and 13.

The device has another cylinder 14 with a piston 15 which is also connected with a piston rod 2. After the conclusion of a forming operation, that is, when the drawing slide 7 is in its lower dead center, by way of a corresponding admission of pressure to the piston 15, which at this point. in time is in its lower position, the pressure cheek 1 is moved against the drawing direction in the direction of arrow 16, back into the basic position toward the top together with all components mounted thereon.

Each drawing cylinder 9 is provided with a drawing rod 17 whose one end is connected with the pressure cheek 1 while the other end projects into a first piston space 18 of the drawing cylinder 9. A drawing piston 19 separates the first piston space 18 from a second piston space 20. The filling of the first piston space 18 takes place by way of a filler line 21 having a return valve 22. The second piston space 20 is connected with a pressure accumulator 23.

A pressure sensor 24 measures the actual pressure in the first piston space 18. A proportional valve 25, which is connected with a tank 26 and a pressure limiting device 27, allows an actual/desired pressure control to take place in a known manner in the respectively first piston space 1 of each drawing cylinder 9 for controlling the forming operation for the sheet 8 by a correspondingly controlled counterpressure with respect to the pressure generated by the drawing slide 7.

The above-described parts are of a known construction and operate in a known manner. If now, for example, because of an emergency switch-off, a press stoppage occurs during a forming operation, a control valve device in the form of an electrovalve device 28 is activated by a corresponding control pulse. The electrovalve device 28 opens up the passage of a pressure medium line 29 from a pump 30 in the direction of four volume controlling members 31. Each of the volume controlling members 31 has a pressure output line 32 which leads to one of the four drawing cylinders 9 and leads out there into the respectively first piston space 18. The pump 30 simultaneously represents the pump for the pressure medium supply of the preacceleration cylinder 3; however, for reasons of clarity, the connecting lines for this purpose are not shown.

Between the pump 30 as the pressure medium generator and the electrovalve device 28 as the control valve device, a valve device 33, which can be path-function activated, is situated in the pressure medium feed line 29. The valve device 33 has a roller tappet 34 as a sensing member whose roller rolls along a curved path 35 on the outer circumference of the piston rod 2.

The path-dependent valve device 33 acts as a, safety device for ensuring that a supplying of the respectively first piston space 18 of each drawing cylinder 9 with pressure medium in the event of a press stoppage takes place only if this is required; that is, only if the press stoppage takes place during a forming operation and thus an admission of pressure in the drawing direction 16 by the drawing slide 7.

As illustrated, the course of the curved path 35 is such that the valve device 33 will let pressure medium pass through in the direction of the electrovalve device 28 only when the piston rod 2 moves downward. After the restoring movement of the piston rod 2 after the conclusion of the forming operation, the passage is closed.

As long as the electrovalve device 28 has not been activated, however, no pressure medium flow is transmitted to the volume controlling members 31. Only in the case of an activation of the electrovalve device 28 in conjunction with a position of the path-dependent valve device 33 during the forming operation for the sheet 8 in the open position, pressure medium is introduced by the pump 30 in each case into the first piston space 18 of each drawing cylinder 9. The pressure sensor 24 and the proportional vales 25, provided that, in a correspondingly metered manner, the pressure in the first piston space 18 is in each case to be controlled such that the pressure existing at the start of the press stoppage in the first piston space is maintained during the entire press stoppage. If the press starts again, the electrovalve device 28 is deactivated and the drawing device continues the forming operation for the sheet 8 in a known manner under the correct piston pressure conditions in the system.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Drawing device for a press, having a drawing slide, a sheet holder with a sheet held therein, a pressure cheek arranged under the sheet holder, and connected with a piston rod displaceable parallel to a drawing direction and operatively connected with a preacceleration piston of a preacceleration cylinder, and drawing cylinders applied to the pressure cheek by drawing rods and having sawing pistons with first and second piston spaces, the first piston space being pressure-controlled during a drawing operation for sheet forming, wherein, in the event of a press stoppage during the sheet forming, a control valve device is arranged to be activated, for maintaining the pressure existing in the first piston space at the start of the press stoppage, during the time of the press stoppage, to permit pressure medium to be charged into the first piston space by a pressure medium generator.

2. Drawing device according to claim 1, wherein the pressure medium generator is a pump.

3. Drawing device according to claim 2, wherein the pump is also operatively associated with the preacceleration cylinder.

4. Drawing device according to claim 1, wherein the control valve device is an electrovalve device connectable with a number of volume controlling members corresponding to a number of the drawing cylinders.

5. Drawing device according to claim 4, wherein the pressure medium generator is a pump.

6. Drawing device according to claim 5, wherein the pump is also operatively associated with the preacceleration cylinder.

7. Drawing device according to claim 1, wherein, a valve device is arranged between the pressure generator and the control valve device, so as to be controllable as a function of path and to release pressure medium flow to the control valve device during a sheet forming time.

8. Drawing device according to claim 7, wherein the valve device is applied to a curved path of the piston rod via a sensing element associated therewith.

9. Drawing device according to claim 8, wherein the sensing element is a roller tappet.

10. Drawing device according to claim 9, wherein the pressure medium generator is a pump.

11. Drawing device according to claim 10, wherein the pump is also operatively associated with the preacceleration cylinder.

12. Drawing device according to claim 11, wherein the control valve device is an electrovalve device connectable with a number of volume controlling members corresponding to a number of the drawing cylinders.

13. Drawing device according to claim 1, wherein the drawing cylinders are provided with a pressure sensor measuring actual pressure value and with a proportional valve controlling pressure in the first piston space.

14. Drawing device according to claim 13, wherein the pressure medium generator is a pump.

15. Drawing device according to claim 14, wherein the pump is also operatively associated with the preacceleration cylinder.

16. Drawing device according to claim 15, wherein the control valve device is an electrovalve device connectable with a number of volume controlling members corresponding to a number of the drawing cylinders.

17. Drawing device according to claim 16, wherein, a valve device is arranged between the pressure generator and the control valve device, so as to be controllable as a function of path and to release pressure medium flow to the control valve device during a sheet forming time.

18. Drawing device according to claim 17, wherein the valve device is applied to a curved path of the piston rod via a sensing element associated therewith.

19. Drawing device according to claim 18, wherein the sensing element: is a roller tappet.

* * * * *